US005078404A

United States Patent [19]

Barillaro et al.

[11] Patent Number: 5,078,404

[45] Date of Patent: Jan. 7, 1992

[54] PORTABLE GAMING TABLE

[76] Inventors: Atilio J. Barillaro; Alexander Barillaro, both of 23806 La Garto, Mission Viejo, Calif. 92691

[21] Appl. No.: 610,368

[22] Filed: Nov. 5, 1990

[51] Int. Cl.[5] ..... A63F 3/00

[52] U.S. Cl. ..... 273/285; 273/309; 273/5 A; 273/8

[58] Field of Search ..... 273/5 A, 5 C, 4 B, 3 A, 273/3 R, 8, 9, 285, 287, 309

[56] References Cited

U.S. PATENT DOCUMENTS

| | | | |
|---|---|---|---|
| 592,941 | 11/1897 | Stahl | 273/5 A |
| 1,269,614 | 6/1918 | Lapp | 273/8 |
| 2,610,055 | 9/1952 | Goodyear | 273/39 |
| 3,591,176 | 7/1971 | Roth | 273/8 |
| 4,041,880 | 8/1977 | Schankman | 108/112 |
| 4,318,543 | 3/1982 | Vollendorf | 273/4 A |
| 4,336,936 | 6/1982 | Young | 273/8 |
| 4,722,530 | 2/1988 | Hendon | 273/309 |
| 4,746,126 | 5/1988 | Angileri | 273/249 |
| 4,872,550 | 10/1989 | Stanges | 206/315.1 |

FOREIGN PATENT DOCUMENTS

| | | | |
|---|---|---|---|
| 150958 | 2/1932 | Switzerland | 273/4 B |

*Primary Examiner*—Benjamin Layno

*Attorney, Agent, or Firm*—Stetina and Brunda

[57] ABSTRACT

This invention relates to a portable and collapsible crap table which may be easily transported and assembled as desired. The crap table is formed from a pair of planar board members, one side of which includes a conventional felt covering having casino crap table indicia formed thereon. The end and side walls of the crap table are formed by a pair of articulated members, with the end walls being pivotally mounted to the side walls to allow collapsing of the same.

14 Claims, 2 Drawing Sheets

COME
PASS LINE
ANY CRAPS
FIELD

PORTABLE GAMING TABLE

FIELD OF THE INVENTION

The present invention relates generally to gaming equipment, and more particularly to a portable and collapsible crap table which may be easily transported and assembled as desired.

BACKGROUND OF THE INVENTION

Many games, particularly card or dice games, require special table surfaces having certain particular markings or indicia thereon to play the game. One such well-known game is casino-style craps. The nature of the markings that must be included on a table surface to properly play casino-style craps and the manner in which the game is played generally necessitate that such tables be relatively large in size (i.e. have a large surface area). As can be appreciated, the large size of a casino-style craps table precludes many individuals from having such a table in their home due to spatial limitations of the various rooms in which the table would be placed. The present invention overcomes this difficulty by providing a casino-style craps table which is portable and collapsible thereby allowing the table to be easily deployed as desired, and quickly collapsed and stored thereafter.

SUMMARY OF THE INVENTION

In accordance with the preferred embodiment of the present invention, there is provided a collapsible, portable casino craps table. The table comprises a generally planar board member which is formed by a pair of interconnected board member portions, each of which define an upper surface and a lower surface. The second board member portion is pivotally connected to the first board member portion such that the first member portion and the second member portion are movable between a first extended position and a second folded position. In the extended position, the upper surfaces of the first member portion and the second member portion form a generally planar surface having a rectangular configuration. When in the folded position, a substantial portion of the upper surface of the second member portion overlaps the upper surface of the first member portion. The upper surfaces of both the first member portion and second member portion are covered by a felt covering. Disposed upon the felt covering are indicia which are related to the game of casino craps.

A rail member is provided which is detachably mountable to the planar board member. The rail member itself is formed of a plurality of rail portions which are interconnected in a manner to permit articulation of each of the rail portions between a first operative orientation wherein the rail member extends about the peripheral edges of the planar board member, and a second stowed orientation wherein the rail portions are removed from the planar board member and disposed in a stacked, overlapping configuration. Advantageously, the rail portions are interconnected in a manner forming a first rail segment and a second rail segment. In this respect, the first rail segment and second rail segment each comprise a back wall having a right side wall and a left side wall pivotally connected to the right and left edges thereof, respectively. Thus, both the first rail segment and the second rail segment are articulable between the operative orientation and the stowed orientation. In this respect, the rail member is formed by the attachment of the first rail segment to the second rail segment when each are in the operative orientation.

The right side wall and left side wall of the first and second rail segments each comprise a first side wall portion and a second side wall portion pivotally connected to the first side wall portion. In this respect, the first side wall portion of the left and right side walls of the first rail segment are connected to the left and right edges, respectively, of the back wall of the first rail segment. Similarly, the first side wall portions of the right and left side walls of the second rail segment are connected to the right and left edges, respectively, of the back wall of the second rail segment.

The pivotal connections between the first and second side wall portions, the first side wall portions and the back walls, and the first and second board member portions are facilitated by one or more hinges. Additionally, as with the first and second board member portions, the first and second rail segments are covered with a felt covering. The felt covering disposed on the inner surfaces of the back walls of the first and second rail segments further includes a layer or sheet of rubber-like material disposed thereon.

As previously specified, the rail member is formed by attaching the first rail segment to the second rail segment. Such attachment is facilitated by the interconnection of a plurality of hooks connected to the second side wall portions of the first rail segment to a plurality of pins disposed within the second side wall portions of the second rail segment, the hooks and pins being sized and oriented on the second side wall portions in a manner facilitating the formation of the rail member. Additionally, the first side wall portions of the first and second rail segments each include an aperture disposed therein which is sized and configured to receive a mechanical fastening member for facilitating the attachment of the rail member to the upper surface of the planar board member.

BRIEF DESCRIPTION OF THE DRAWINGS

These as well as other features of the present invention will become apparent upon reference to the drawings wherein.

DETAILED DESCRIPTION OF THE PREFERRED EMBODIMENT

Figures 1, 2:
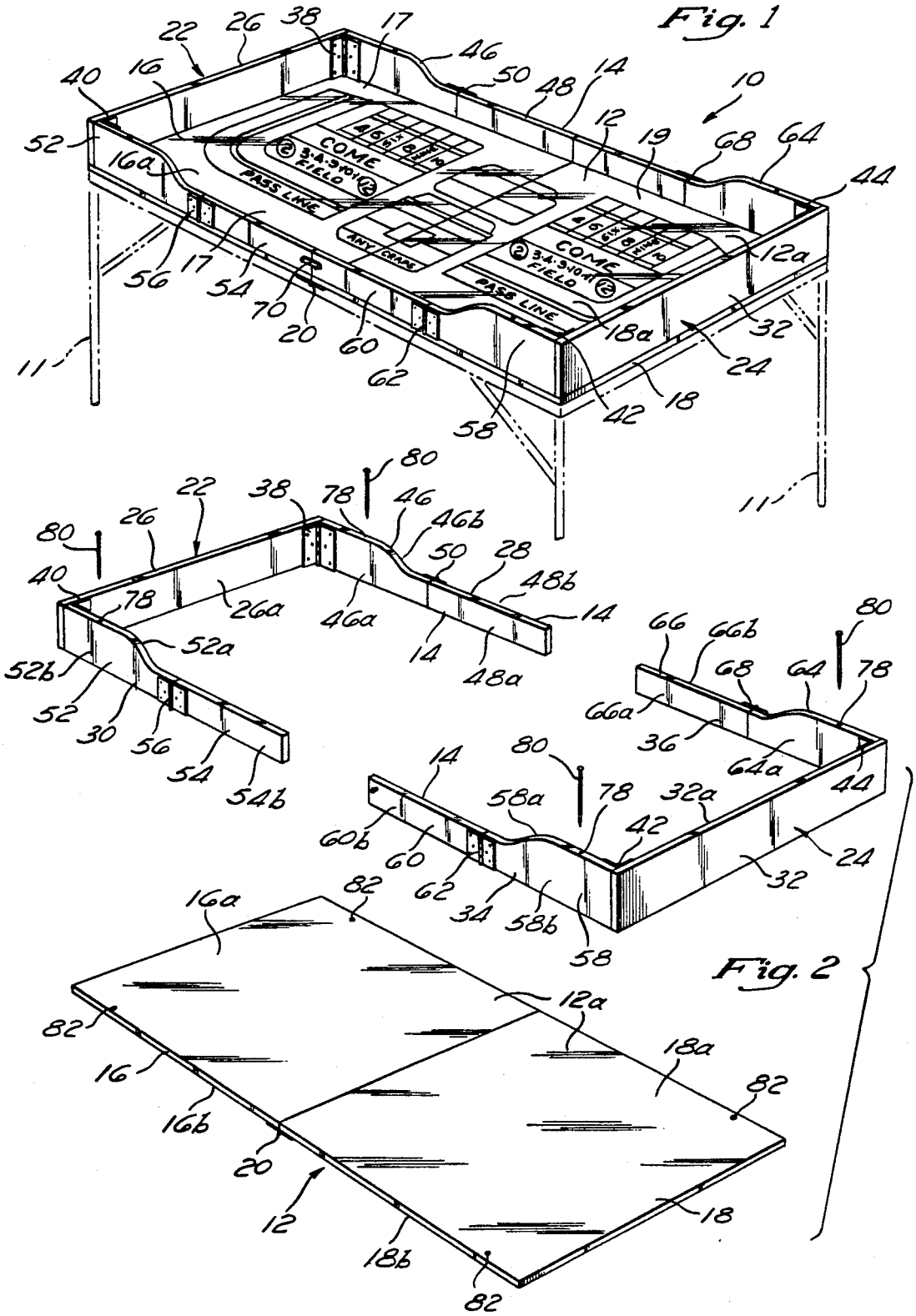
FIG. 1 is a perspective view of the portable crap table of the present invention.
FIG. 2 is an exploded view of the portable crap table of the present invention.
Figure 3:
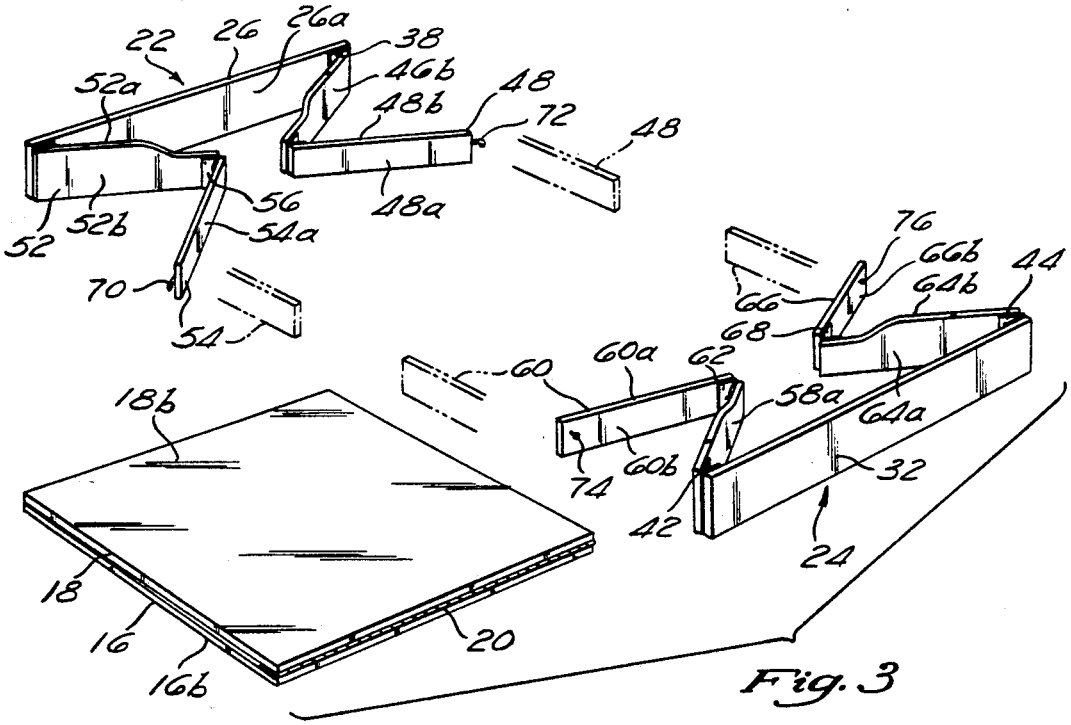
FIG. 3 is a perspective view of the various components comprising the crap table of the present invention, illustrating the manner in which such components are placed in a stowed configuration.

Referring now to the drawings wherein the showings are for purposes of illustrating a preferred embodiment of the present invention only and not for purposes of limiting the same, FIG. 1 perspectively illustrates a portable, collapsible casino-style craps table 10 constructed in accordance with the preferred embodiment of the present invention. In the preferred embodiment, table 10 is adapted to be placed upon an existing support table (shown in phantom in FIG. 1) though it will be appreciated that table 10 may be provided with collapsible legs or other types of support devices. Table 10 generally comprises a planar board member 12 having a rail member 14 detachably connected to the upper surface 12*a* thereof in a manner whereby rail member 14 extends about the peripheral edges of the planar board member 12. As best seen in FIG. 2, the planar board member 12 comprises a first board member portion 16 defining an upper surface 16*a* and a lower surface 16*b*, and a second board member portion 18 defining an upper surface 18*a* and a lower surface 18*b*. In the preferred embodiment of the present invention, second board member portion 18 is pivotally connected to first board member portion 16 such that first board member portion 16 and second board member portion 18 are movable between a first extended position wherein first board member portion 16 and second board member portion 18 form planar board member 12 (as seen in FIG. 2) and a second folded position wherein a substantial portion of upper surface 18*a* of second board member portion 18 overlaps upper surface 16*a* of first board member portion 16 (as seen in FIG. 3). The pivotal connection between first board member portion 16 and second board member portion 18 is preferably facilitated by at least one hinge 20, though other methods of obtaining such a pivotal connection may be utilized. Additionally, planar board member 12 preferably has a generally rectangular configuration. As seen in FIG. 1, upper surface 16*a* of first board member portion 16 is covered by a first felt covering 17, and upper surface 18*a* felt covering 19. In this respect, felt coverings 17, 19 each comprise single sheets which are operable to cover upper surfaces 16*a*, 18*a*, respectively. Disposed upon the felt coverings 17, 19 are conventional indicia which define the gaming surface (i.e. the game of casino-style craps) upon upper surface 12*a* of board member 12. Such indicia include, for instance, a "pass line", a "don't pass bar", a "field", a "come line", a "back line", a "hard way", an "any craps" field and the like.

Figure 5:
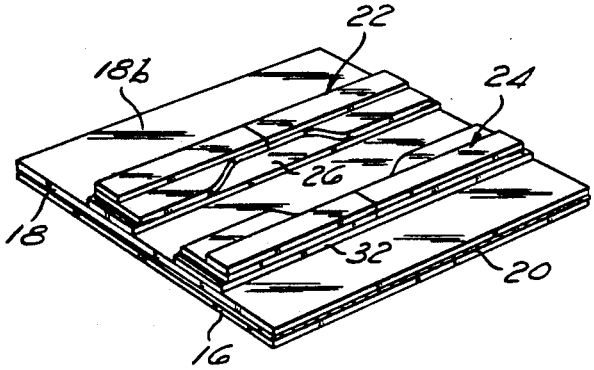
FIG. 5 is a perspective view illustrating the various components of the table of the present invention in a stowed configuration.

As previously specified, rail member 14 is detachably mountable to the upper surface 12*a* of planar board member 12. Rail member 14 generally comprises a first rail segment 22 and a second rail segment 24. As seen in FIGS. 2 and 3, first rail segment 22 comprises a back wall 26 defining an inner surface 26*a* and having a right side wall 28 pivotally connected to the right edge thereof and a left side wall 30 pivotally connected to the left edge thereof. Similarly, second rail segment 24 comprises a back wall 32 defining an inner surface 32*a* and having a right side wall pivotally connected to the right edge thereof and a left side wall 36 pivotally connected to the left edge thereof. The pivotal connection between right side wall 28 and back wall 26 is facilitated by a hinge 38 while the pivotal connection between left side wall 32 and back wall 26 is facilitated by a hinge 40. Similarly, the pivotal connection between right side wall 34 and back wall 32 is facilitated by a hinge 42 while the pivotal connection between left side wall 36 and back wall 32 is facilitated by a hinge 44. Right side wall 28 of first rail segment 22 further comprises a first side wall portion 46 having a second side wall portion 48 pivotally connected thereto by a hinge 50, while left side wall 30 further comprises a first side wall portion 52 having a second side wall portion 54 pivotally connected thereto by a hinge 56. Similarly, right side wall 34 of second rail segment 24 further comprises a first side wall portion 58 having a second side wall portion 60 pivotally connected thereto by a hinge 62, while left side wall 36 further comprises a first side wall portion 64 having a second side wall portion 66 pivotally connected thereto by a hinge 68. As can be appreciated by the pivotal interconnection of the various members comprising first rail segment 22 and second rail segment 24, both first rail segment 22 and second rail segment 24 are articulable between a first operative orientation and a second stowed orientation. When in the operative orientation, first rail segment 22 and second rail segment 24 are in the orientation shown in FIG. 2, wherein right side wall 28 and left side wall 30 extend transversely from the inner surface 26*a* of back wall 26, and right side wall 34 and left side wall 36 of second rail segment 24 extend transversely from inner surface 32*a* of back wall 32. Thus, the connection of first rail segment 22 to second rail segment 24 while each are in the operative orientation facilitates the formation of rail J member 14 in a manner whereby rail member 14 extends about the peripheral edges of planar board member 12. As seen in FIG. 3, both first rail segment 22 and second rail segment 24 are also articulable into a second stowed configuration when removed from the upper surface 12*a* of planar board member 12 and disconnected from each other. With respect to first rail segment 22, when in the stowed configuration inner surfaces 46*a*, 52*a* of first side wall portions 46, 52, respectively, overlap inner surface 26*a* of back wall 26, and outer surfaces 48*b*, 54*b* of second side wall portions 48, 54, respectively, overlap outer surfaces 46*b*, 52*b* of first side wall portions 46, 52, respectively. Similarly, when second rail segment 24 is in the stowed configuration, inner surfaces 58*a*, 64*a* of first side wall portion 58, 64, respectively, overlap inner surface 32*a* of back wall 32 and outer surfaces 60*b*, 66*b* of second side wall portions 60, 66, respectively, overlap outer surfaces 58*b*, 64*b* of first side wall portions 58, 64, respectively. The process of articulating first rail segment 22 and second rail segment into the stowed configuration is shown in FIG. 3, while FIG. 5 illustrates first rail segment 22 and second rail segment 24 after being completely stowed.

Figure 4:
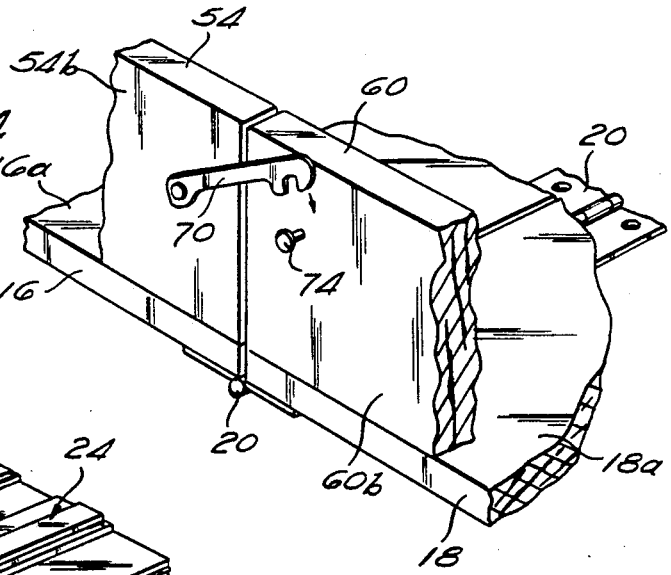
FIG. 4 is a perspective view of a section of the crap table of the present invention, illustrating the latch hook and pin assembly used to facilitate the formation of the rail member of the table.

As previously specified, rail member 14 is formed by the attachment of first rail segment 22 to second rail segment 24 when each are in the operative (i.e. extended) orientation. To facilitate the attachment of first rail segment 22 to second rail segment 24, disposed on the outer surface 54*b* of second side wall portion 54 is a first latch hook 70, while disposed on the outer surface 48*b* of second side wall portion 48 is a second latch hook 72. Additionally, disposed on the outer surface 60*b* of second side wall portion 60 is a first latch pin 74, while Additionally, disposed on the outer surface 66*b* of second side wall disposed on the outer surface 66*b* of second side wall portion 66 is a second latch pin 76. As best seen in FIG. 4, first latch hook 70 and first latch pin 74 are oriented on outer surfaces 54*b*, 60*b*, respectively, in an orientation whereby first latch hook 70 may be connected to first latch pin 74. Though not shown, second latch hook 72 and second latch pin 76 are oriented on outer surfaces 48*b*, 66*b* in the same orientation as previously described with respect to first latch hook 70 and first latch pin 74. As will be appreciated, the interconnection of first latch hook 70 to first latch pin 74 and second latch hook 72 to second latch pin 76 facilitates the attachment of first rail segment 22 to second rail segment 24. It will further be appreciated that other methods for connecting first rail segment 22 to second rail segment 24 may be used as an alternative to the aforementioned hook and pin assemblies.

Referring now to FIG. 2, as previously specified, first rail segment 22 and second rail segment 24, after being connected to each other to form rail member 14, are secured to the upper surface 12*a* of planar board member 12. In this regard, first side wall portions 46, 52, 58, 64 each include an aperture 78 extending therethrough which is sized and configured to receive a mechanical fastening member 80. In this regard, after each mechanical fastener 80 has been disposed within an aperture 78, such fasteners 80 are received into openings 82 disposed in upper surface 16*a* of first member portion 16 and upper surface 18*a* of second member portion 18 in a configuration whereby each of openings 82 will be in alignment with an aperture 78. It will be appreciated that additional mechanical fastening members may be included at various locations about the periphery of rail member 14 to more rigidly secure rail member 14 to upper surface 12*a* of planar board member 12. In the preferred embodiment, planar board member 12, first rail segment 22, and second rail segment 24 are each constructed from wood, though it will be appreciated that other materials (i.e. metal, plastic) may be used as an alternative.

Additional modifications and improvements of the present invention may also be apparent to those skilled in the art. Thus, the particular combination of parts described and illustrated herein is intended to represent only one embodiment of the invention, and is not intended to serve as limitations of alternative devices within the spirit and scope of the invention.

What is claimed is:

1. A collapsible, portable gaming table comprising:

a generally planar board member defining an upper surface, said board member being formed of at least a pair of interconnected board member portions;

indicia disposed upon said upper surface of said planar board member, said indicia defining a game surface; and a rail member detachable mountable to said upper surface of said planar board member, said rail member comprising a first rail segment and a second rail segment releasably connected to said first rail segment, said first and second rail segments each comprising:

a back wall having an inner surface;

a first right side wall portion pivotally connected to said back wall;

a second right side wall portion pivotally connected to said first right side wall portion;

a first left side wall portion pivotally connected to said back wall; and a second left side wall portion pivotally connected to said first left side wall portion;

said first rail segment and said second rail segment each being articulable between an operative orientation wherein said first and second rail segments, when connected and mounted to said board member, will extend about the peripheral edges of said board member, and a stowed orientation wherein said first and second rail segments, when disconnected and removed from said board member, are each disposed in an overlapping orientation.

2. The table of claim 1 wherein said planar board member comprises:

a first board member portion having a first upper surface; and a second board member portion having a second upper surface, said second board member portion being pivotally connected to said first board member portion so as to be movable between an extended position wherein said first board member portion and said second board member portion form said planar board member, and a folded position wherein a substantial portion of said first upper surface.

3. The table of claim 2 wherein said planar board member has a generally rectangular configuration.

4. The table of claim 2 wherein the pivotal connection between said first board member portion and said second board member portion is facilitated by at least one hinge.

5. The table of claim 1 wherein said upper surface of said planar board member is covered by a felt covering.

6. The table of claim 5 wherein said indicia are formed upon said felt covering.

7. The table of claim 1 wherein the pivotal connection between said first side wall potion and said back wall and said first left side wall portion and said back wall of said first and second rail segments is facilitated by at least one hinge.

8. The table of claim 7 wherein the pivotal connection between said first right side wall portion and said second right side wall portion and between said first left side wall portion and said second left side wall portion of said first and second rail segments is facilitated by at least one hinge.

9. The table of claim 1 further including means for securing said rail member to said upper surface of said planar board member.

10. The table of claim 9 wherein said securing means comprises an aperture disposed within said first side wall portion and said first left side wall portion of said first and second rail segments, said aperture being sized and configured to receive a mechanical fastening member.

11. The table of claim 1 further including means for attaching said first rail segment to said second rail segment.

12. The table of claim 11 wherein said attaching means comprises:

a first latch hook disposed on said second right side wall portion of said first rail segment;

a second latch hook disposed on said second left side wall portion of said first rail segment;

a first latch pin disposed within said second right side wall portion of said second rail segment; and a second latch pin disposed within said second left side wall portion of said second rail segment;

said first and second latch hooks and said first and second latch pins being sized and oriented such that said first latch hook is securable to said second latch pin and said second latch hook is securable to said first latch pin.

13. The table of claim 1 wherein said first and second rail segments are covered with a felt covering.

14. The table of claim 13 wherein said inner surface of said back wall of said first and second rail segments includes a layer of rubberized material disposed thereon.

* * * * *